United States Patent [19]

Skaggs

[11] 4,120,442

[45] Oct. 17, 1978

[54] PARTITION ARRANGEMENT

[75] Inventor: Boyd T. Skaggs, Louisville, Ky.

[73] Assignee: Container Corporation of America, Chicago, Ill.

[21] Appl. No.: 876,521

[22] Filed: Feb. 10, 1978

[51] Int. Cl.[2] ..... B65D 5/48; B65D 25/04

[52] U.S. Cl. ..... 229/15

[58] Field of Search ..... 229/15, 42

[56] References Cited

U.S. PATENT DOCUMENTS

| | | | |
|---|---|---|---|
| 2,908,436 | 10/1959 | Miller | 229/15 |
| 3,152,744 | 10/1964 | Vrana | 229/15 |
| 3,199,759 | 8/1965 | Hickin | 229/15 |
| 3,441,193 | 4/1969 | Castle | 229/15 X |
| 3,478,947 | 11/1969 | Schillinger | 229/15 |
| 3,640,445 | 2/1972 | Durham | 229/15 |
| 3,738,561 | 6/1973 | Nederveld | 229/15 |
| 3,963,169 | 6/1976 | Gardner | 229/15 |
| 3,982,684 | 9/1976 | David | 229/15 X |

*Primary Examiner*—Davis T. Moorhead
*Attorney, Agent, or Firm*—Carpenter & Ostis

[57] ABSTRACT

An internal partition device formed of a unitary blank of paperboard for providing six cells within a package or container.

7 Claims, 3 Drawing Figures

PARTITION ARRANGEMENT

SUMMARY OF THE INVENTION

It is an object of this invention to provide a one piece paperboard partition or divider for forming six cells within a package such as a paperboard shipping container.

A more specifice object of the invention is to provide a partition which is particularly adaptable to be set up easily and also which is capable of being easily returned to its flat form for reuse.

A more specific object of the invention is to provide a partition arrangement including a pair of transverse partition members and a longitudinal partition member having end portions projecting through apertures in the transverse partition members to provide additional rigidity for the structure. .

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
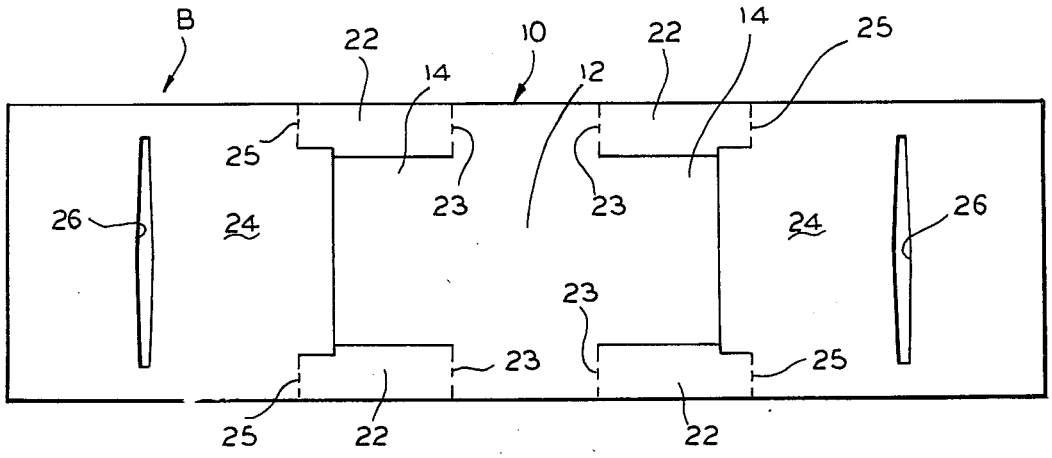
FIG. 1 is a plan view of a blank of foldable sheet material from which the partition illustrated in the other views may be formed.
Figure 2:
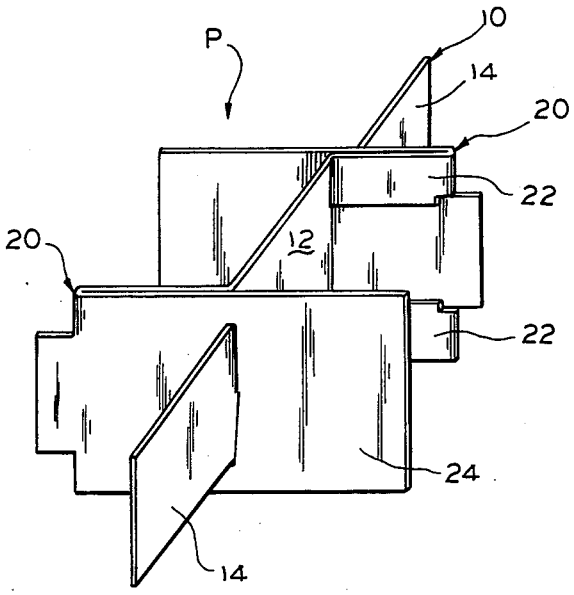
FIG. 2 is a perspective view of a partition structure embodying features of the invention, as shown in the fully erected condition.
Figure 3:
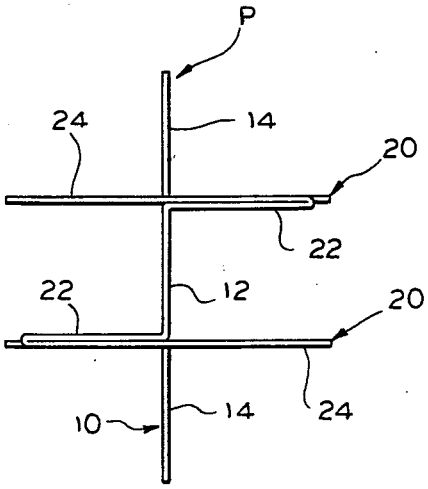
FIG. 3 is a plan view of the structure illustrated in FIG. 2.

Referring now to the drawings for a better understanding of the invention, it will be seen that a partition indicated generally at P and illustrated in FIGS. 2 and 3, may be formed from a unitary blank B of foldable sheet material, such as paperboard, as illustrated in FIG. 1.

Partition P includes a vertically disposed longitudinal partition member 10 having a center portion 12 with a pair of integral end portions 14 projecting from opposite ends thereof.

Partition P also includes a pair of vertically disposed transverse partition members 20 which are spaced from each other longitudinal of the partition a distance equal to the length of the center portion 12.

Each of the transverse partition members 20 includes at least one inner panel element 22 and an outer panel element 24 disposed against each other in face to face relation.

As best seen in FIGS. 1 and 2, inner elements 22 each preferably include a pair of vertically spaced, relatively narrow panels which are formed from material cut partially from longitudinal partition member 10 and a related outer panel element 24. Each of the inner panel elements 22 are foldably joined at their inner edges along fold lines 23 to upper and lower end edges of longitudinal partition member center portion 12, and are foldably joined at their outer edges along fold lines 25 to related outer edges of adjacent outer panels 24.

It will be noted that both of the outer panels 24 are provided with centrally located, vertically extending slots 26 through which the end portions 14 of longitudinal partition member 10 extend.

In order to erect the device, both of the outer panels are folded inwardly 180° about fold lines 25. The inner panel elements 22 are then folded 90° about fold lines 23 and at the same time the end portions 14 of the longitudinal partition member 10 are inserted through the respective slots 26 of the outer panels.

Thus it will be appreciated that the invention provides a relatively rigid partition arrangement of simple and economic design and construction which can be readily assembled and can also be readily disassembled and returned to the flattened condition for eventual reuse.

I claim:

1. A one-piece, six-cell partition, formed from a unitary blank of foldable paperboard, comprising:

(a) a flat, vertically disposed, longitudinal member having a center portion and a pair of integral end portions;

(b) a pair of vertically disposed transverse members spaced from each other a distance equal to the length of the longitudinal member center portion;

(c) each of said transverse members including:

(i) an inner element foldably joined at an inner vertical edge to an adjacent vertical end edge of said longitudinal member center portion;

(ii) an outer element foldably joined at an outer vertical edge to a corresponding outer vertical edge of said inner member and disposed thereagainst in parallel relation therewith;

(d) each of said longitudinal member end sections extending beyond a related transverse member and through an opening in the outer element thereof.

2. A partition according to claim 1, wherein each of said transverse member inner elements includes a pair of relatively thin, elongated sections spaced vertically from each other and joined to said longitudinal member center portion and said transverse member outer element on fold lines which are aligned with each other.

3. A partition according to claim 1, wherein the inner element of each said transverse members has a length which is approximately one half of the length of the outer element thereof.

4. A partition according to claim 1, wherein each of said transverse member outer element slots is spaced inboardly from the periphery of said outer element.

5. A partition according to claim 1, wherein said longitudinal member center portion is generally cross-shaped.

6. A partition according to claim 1, wherein said partition is formed from a rectangular blank.

7. A partition according to claim 1, wherein each of said transverse member inner elements is cut partly from material of said longitudinal member and partly from material of a related transverse member outer element.

* * * * *